US009980618B2

(12) United States Patent
Koura et al.

(10) Patent No.: US 9,980,618 B2
(45) Date of Patent: May 29, 2018

(54) DUST COLLECTING DEVICE

(71) Applicant: MAKITA CORPORATION, Anjo-shi, Aichi (JP)

(72) Inventors: Kentaro Koura, Anjo (JP); Hiroshi Yamaguchi, Anjo (JP)

(73) Assignee: MAKITA CORPORATION, Anjo-shi (JP)

( * ) Notice: Subject to any disclaimer, the term of this patent is extended or adjusted under 35 U.S.C. 154(b) by 620 days.

(21) Appl. No.: 14/613,954

(22) Filed: Feb. 4, 2015

(65) Prior Publication Data

US 2015/0223652 A1 Aug. 13, 2015

(30) Foreign Application Priority Data

Feb. 13, 2014 (JP) ..... 2014-025616
Feb. 13, 2014 (JP) ..... 2014-025617
Feb. 13, 2014 (JP) ..... 2014-025618

(51) Int. Cl.
*A47L 5/36* (2006.01)
*A47L 9/32* (2006.01)
(Continued)

(52) U.S. Cl.
CPC ..... *A47L 5/365* (2013.01); *A47L 9/22* (2013.01); *A47L 9/2868* (2013.01);
(Continued)

(58) Field of Classification Search
CPC ..... A47L 5/365; A47L 11/4075; A47L 9/32; A47L 9/327
(Continued)

(56) References Cited

U.S. PATENT DOCUMENTS 4,893,375 A 1/1990 Girman et al.
5,373,606 A 12/1994 Bosyj et al.
(Continued)

FOREIGN PATENT DOCUMENTS

CN 1323565 A 11/2001
CN 101733266 A 6/2010
(Continued)

OTHER PUBLICATIONS

S61-070984 (English translation).*
(Continued)

*Primary Examiner* — Andrew A Horton
(74) *Attorney, Agent, or Firm* — Oliff PLC

(57) ABSTRACT

A dust collecting device includes a tank and a main body housing a motor and detachably attachable to an upper part of the tank. A handle and a cover are both provided in an upper part of the main body. The handle is capable of being raised and turned down around a handle rotation shaft. The cover is capable of being opened and closed around a cover rotation shaft and covers a housing portion provided in the main body in a closed position. The cover rotation shaft is provided in parallel to the handle rotation shaft. The cover rotation shaft is positioned closer to a grip portion of the handle than the handle rotation shaft so as to overlap with a part of the handle. The handle rotation shaft is positioned closer to the cover than the cover rotation shaft so as to overlap with a part of cover.

16 Claims, 15 Drawing Sheets

(51) Int. Cl.
*A47L 9/22* (2006.01)
*A47L 9/28* (2006.01)
*A47L 11/40* (2006.01)

(52) U.S. Cl.
CPC ..... *A47L 9/2884* (2013.01); *A47L 9/32* (2013.01); *A47L 9/327* (2013.01); *A47L 11/4005* (2013.01); *A47L 11/4075* (2013.01)

(58) Field of Classification Search
USPC ..... 15/327.2
See application file for complete search history.

(56) References Cited

U.S. PATENT DOCUMENTS

| | | | | |
|---|---|---|---|---|
| 5,638,574 | A * | 6/1997 | Haupt | A01G 1/125 15/330 |
| 5,943,731 | A | 8/1999 | Wood | |
| 5,954,863 | A | 9/1999 | Loveless et al. | |
| 2005/0102790 | A1* | 5/2005 | Matsuno | A47L 9/0081 15/326 |
| 2005/0108849 | A1 | 5/2005 | Lam | |
| 2006/0130269 | A1 | 6/2006 | Bott et al. | |
| 2008/0062618 | A1 | 3/2008 | Frank et al. | |

FOREIGN PATENT DOCUMENTS

| | | | |
|---|---|---|---|
| CN | 103220954 | A | 7/2013 |
| EP | 0 790 031 | A1 | 8/1997 |
| JP | S48-059161 | U | 7/1973 |
| JP | S56-019153 | U | 2/1981 |
| JP | S59-156720 | A | 9/1984 |
| JP | S61-070984 | U | 5/1986 |
| JP | S62-134533 | U | 8/1987 |
| JP | H03-165722 | | 7/1991 |
| JP | 2002-164672 | A | 6/2002 |
| JP | 2003-235770 | A | 8/2003 |
| JP | 2008-048799 | A | 3/2008 |
| JP | 2010-119505 | A | 6/2010 |
| JP | 2013-541395 | A | 11/2013 |
| JP | 2014-018266 | A | 2/2014 |
| WO | 2013-077122 | A1 | 5/2013 |

OTHER PUBLICATIONS

Apr. 29, 2017 Office Action issued in Japanese Patent Application No. 2014-025617.
Apr. 18, 2017 Office Action issued in Japanese Patent Application No. 2014-025618.
Jun. 19, 2015 Partial Search Report issued in European Application No. 15 15 4869.0.
Nov. 28, 2017 Office Action issued in Japanese Patent Application No. 2014-025617.
Dec. 5, 2017 Office Action issued in Japanese Patent Application No. 2014-025618.
Jan. 3, 2018 Office Action issued in Chinese Patent Application No. 201510075823.5.
Apr. 17, 2018 Office Action issued in Japanese Patent Application No. 2014-025617.
Apr. 17, 2018 Office Action issued in Japanese Patent Application No. 2014-025618.

* cited by examiner

DUST COLLECTING DEVICE

This application claims the benefit of Japanese Patent Application Numbers 2014-025616, 2014-025617 and 2014-025618, all filed on Feb. 13, 2014, the entirety of which is incorporated by reference.

BACKGROUND OF THE INVENTION

Field of the Invention

The present invention relates to a dust collecting device provided with a main body having a drive part so as to be detachably attached above a tank storing the dust and the like.

Description of Related Art

A dust collecting device includes a main body that houses, for example, a motor having a blower fan as a drive part and is detachably placed above a tank. When the blower fan is rotated by driving of the motor, outside air is sucked through a hose connected to a suction opening provided in the tank and passes through the inside of the tank and the main body. During this process, the dust and the like in the sucked outside air is caught by a filter provided in the tank and stored inside the tank. A handle is provided on an upper surface of the main body for facilitating movement of the dust collecting device and so on (for example, Japanese Patent Application Publication No 2010-119505).

In some of such dust collecting devices, a battery is detachably attached to the main body as a power source, and a housing portion for the battery is opened and closed by a cover. However, when both the handle and the cover are provided, not only the size of the main body but also the product size is increased. On the other hand, when the product size is reduced, the cover is also reduced and it becomes difficult to form a large opening, as a result, it is hard to attach and detach the battery.

SUMMARY OF THE INVENTION

In view of the above, an object of the present invention is to provide a duct collecting device that secures a large opening in the cover without increasing the product size even when both the handle and the cover are provided in order to facilitate attachment and detachment of the battery and the like.

According to an embodiment of the present invention, there is provided a dust collecting device that includes a tank, and a main body housing a motor and configured to be detachably attached to an upper part of the tank. A handle and a cover are both provided in an upper part of the body. The handle is capable of being raised and turned down around a handle rotation shaft. The cover is capable of being opened and closed around a cover rotation shaft and covers a housing portion provided in the main body in a closed position. The cover rotation shaft is parallel to the handle rotation shaft. The cover rotation shaft is positioned closer to a grip portion of the handle than the handle rotation shaft so that the cover rotation shaft overlaps with a part of the handle. The handle rotation shaft is positioned closer to the cover than the cover rotation shaft so that the handle rotation shaft overlaps with a part of the cover.

In the above structure, the housing portion is provided with a battery connection portion for connecting a battery.

Further, in the above structure, a switch for activating the motor is arranged in a front part of the main body, the handle is arranged in a rear side of the switch and the cover is arranged in a rear side of the handle respectively.

Further, in the above structure, a clearance recessed portion facing the handle in the turned-down state is formed on an upper surface of the main body.

Further, in the above structure, a pipe support portion which can support a pipe is provided in the main body, and the cover has a shape not interfering with the pipe supported by the pipe support portion at the time of opening and closing.

In addition to the above, it is preferable to provide a hook elastically locked to the main body in a closed position of the housing portion and to provide a detachably attachable housing box in the main body.

According to another embodiment of the prevent invention, there is provided a dust collecting device that includes a tank and a main body housing a motor and configured to be detachably attached to an upper part of the tank. In the dust collecting device, a switch for activating the motor is arranged in a front part of the main body, a battery connection portion for connecting a battery is arranged in a rear part of the main body, and a handle extending in a right and left direction is arranged in an upper part of the main body.

According to the embodiment of the present invention, it is possible to secure a large opening in the cover without increasing the product size even when both the handle and the cover are provided. Attachment and detachment of the battery and the like can thus be facilitated.

DESCRIPTION OF EMBODIMENTS

Hereinafter, an embodiment of the present invention will be explained with reference to the drawings.

Figure 1:
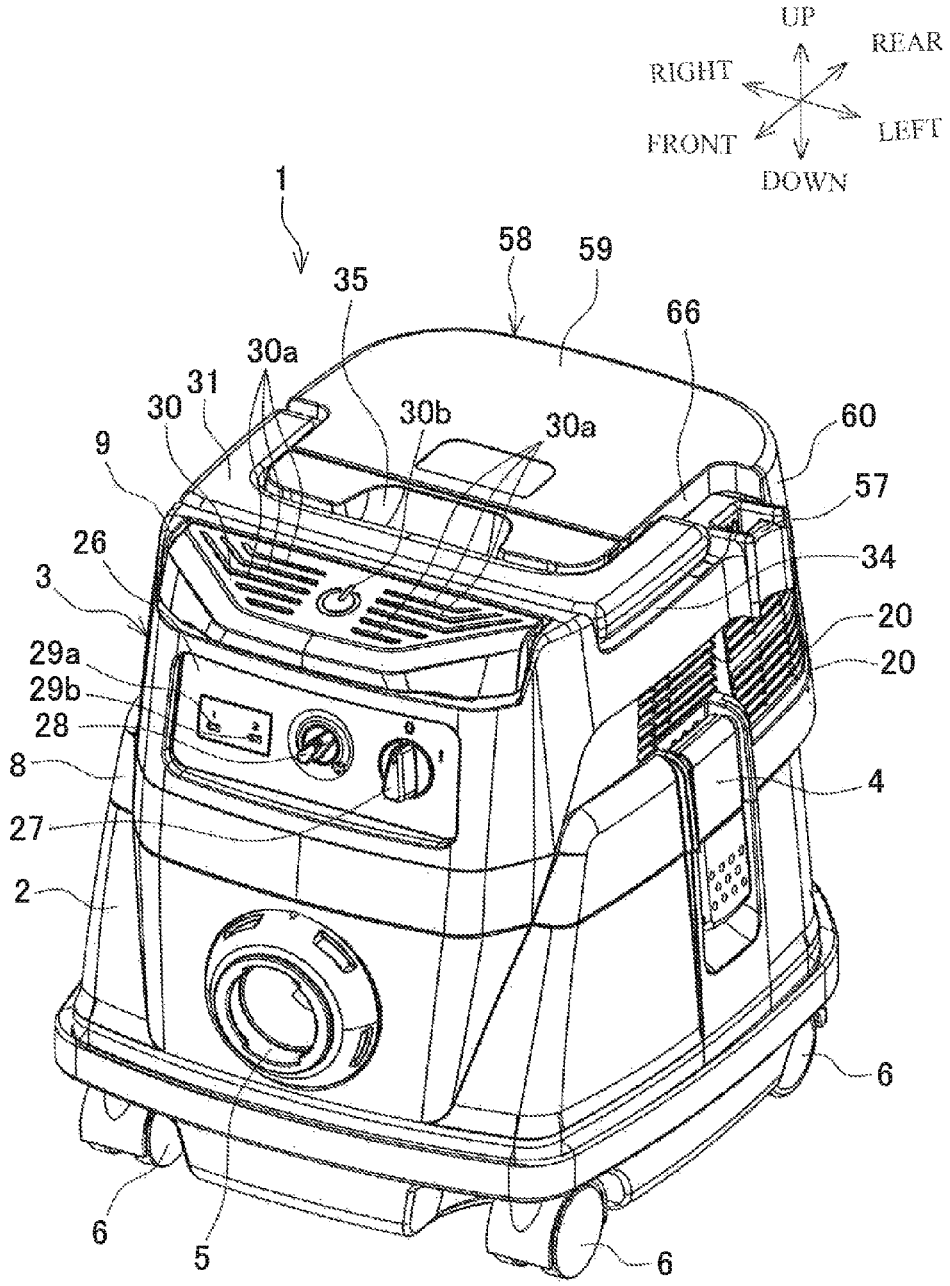
FIG. 1 is a perspective view of a dust collecting device seen from the front side.
Figure 2:
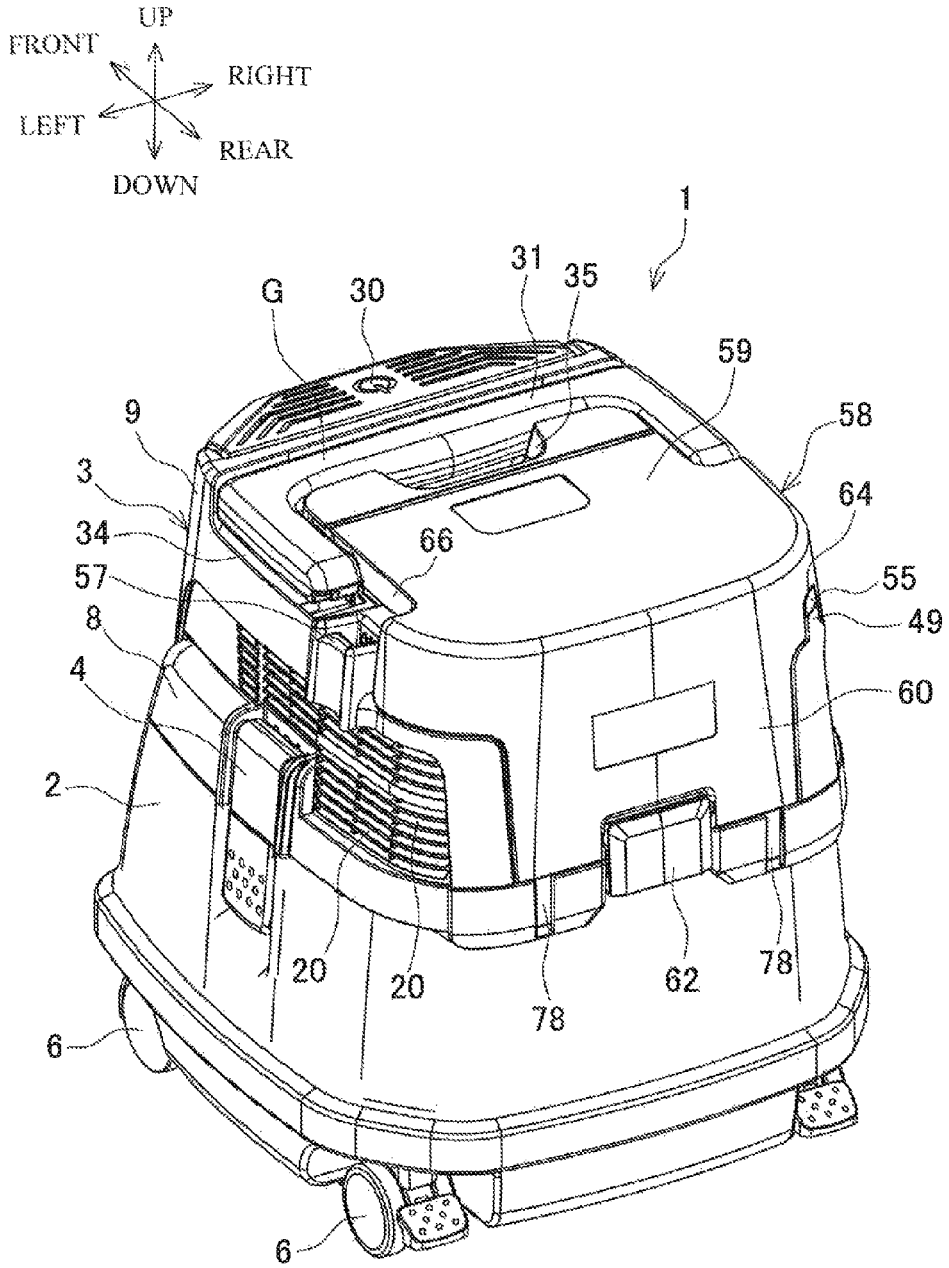
FIG. 2 is a perspective view of the dust collecting device seen from the rear side.
Figure 3:
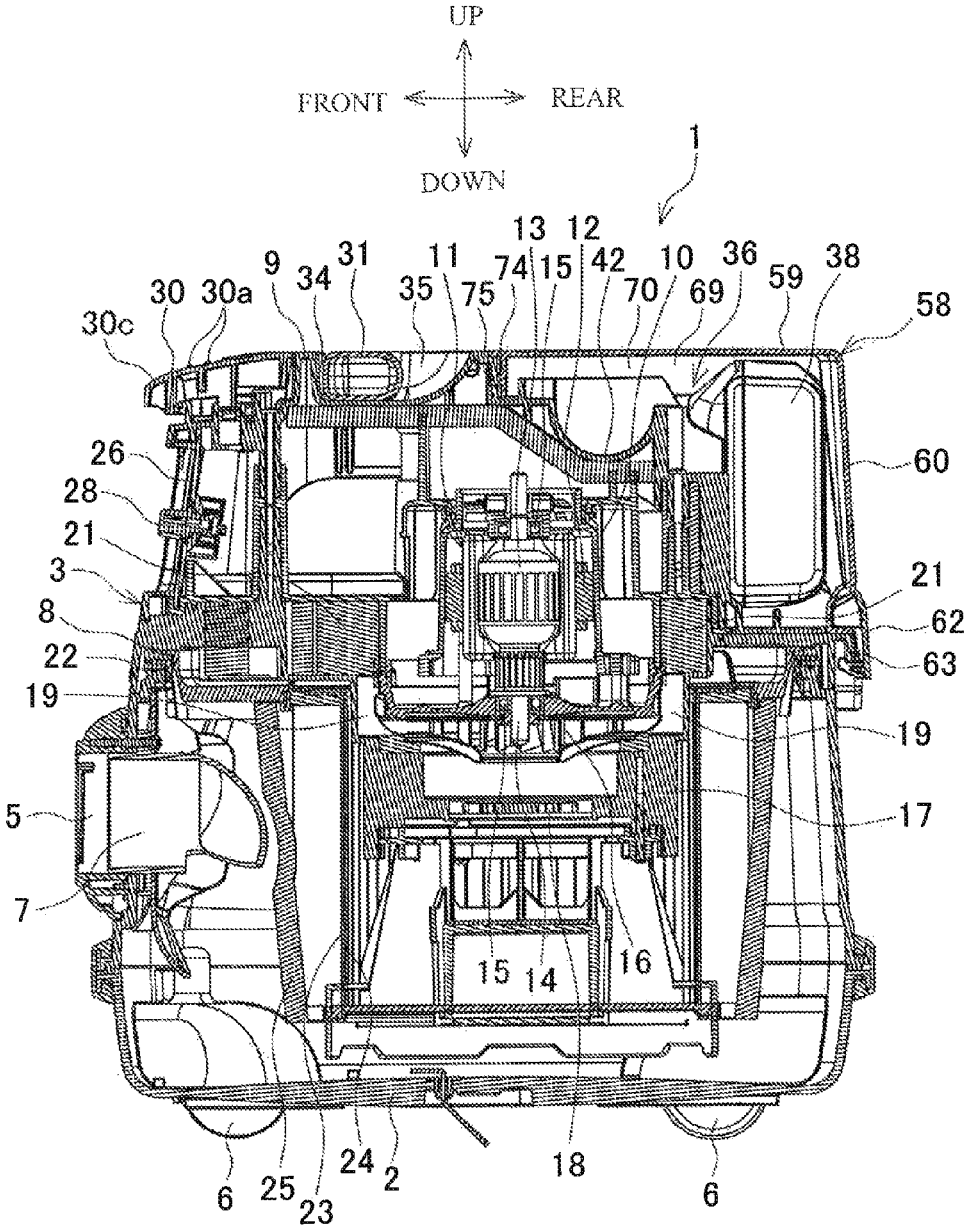
FIG. 3 is a vertical cross-sectional view of the dust collecting device.

FIG. 1 and FIG. 2 are outside drawings showing an example of a dust collecting device and FIG. 3 is a vertical cross-sectional view thereof. A dust collecting device 1 includes a tank 2 whose upper end is opened, and a main body 3 that has a motor 11 as a drive part and a blower fan 16. The main body 3 is placed above a tank 2. In the state where the main body 3 is placed above the tank 2, latches 4, 4 provided right and left of the tank 2 are locked to side faces of the main body 3 so that the main body 3 is detachably connected to the tank 2. A suction opening 5 to which a not-shown hose can be connected is provided in a front face of the tank 2, and pairs of casters 6, 6 . . . (casters 6, 6 in the rear side have stoppers) are provided in front and back in a lower side of the tank 2. A guide cylinder 7 for guiding the air sucked into the tank 2 to a lower direction is provided in the suction opening 5.

The main body 3 includes a lower cowling 8 that closes the opening of the tank 2, and an upper cowling 9 that is connected to the lower cowling 8 and covers an upper surface and a circumferential surface of the main body 3. A housing portion 10 of the motor 11 is formed between the upper and lower cowlings 8 and 9 at approximately the center of the main body 3. The motor 11 has a stator 12 fixed inside the housing portion 10 and a rotor 13 positioned at the center of the stator 12. An output shaft 14 provided at a shaft center of the rotor 13 is pivotally supported in the downward direction by upper and lower bearings 15, 15 provided in the housing portion 10. The blower fan 16 is firmly fixed to a lower end of the output shaft 14 protruding from the housing portion 10. In the lower cowling 8, a cylindrical portion 17 protruding downward is formed just below the housing portion 10, and an air inlet 18 provided at the center of the cylinder portion 17 is coaxially positioned under the output shaft 14.

Moreover, a discharge passage 19 for air passing through the blower fan 16 is formed between the lower cowling 8 and the housing portion 10. The discharge passage 19 is communicated to exhaust ports 20, 20 formed on right and left side faces of the upper cowling 9. A numeral 21 denotes a sound absorbing material (sponge) arranged in the discharge passage 19. Furthermore, a support plate 22 supporting a cylindrical frame 23 which covers an outer periphery of the cylinder portion 17 is provided between the lower cowling 8 and the opening of the tank 2, and a filter 24 is provided on the frame 23. The support plate 22 is provided with an elastic member 25 at the outside of the filter 24. The elastic member 25 is positioned inside a not-shown bag-shaped prefilter and returns the prefilter contracted at the time of suction to an original shape.

An operation panel 26 is provided in a front face of the main body 3. In the operation panel 26, a dial-type operation switch 27, a suction force adjustment grip 28 which is also a dial type, and display portions 29*a*, 29*b* indicating an attachment state and a remaining capacity state of later-described two battery packs are provided. In this case, a push-down type operation switch 30 is provided in an upper side of the operation panel 26. The operation switch 30 includes plural protrusions 30*a* as slip stoppers provided right and left, and a switch display portion 30*b* arranged therebetween. The operation switch 30 is formed large in size and extends right and left at an upper front side of the main body 3. Therefore, it is easy to use the operation switch 30. As the operation switch 30 has an inclined portion 30*c* inclined downward toward the front side as shown in FIG. 3, which further facilitates the operation. These switches are connected to a not-shown controller provided on a reverse side of the operation panel 26.

Figure 4:
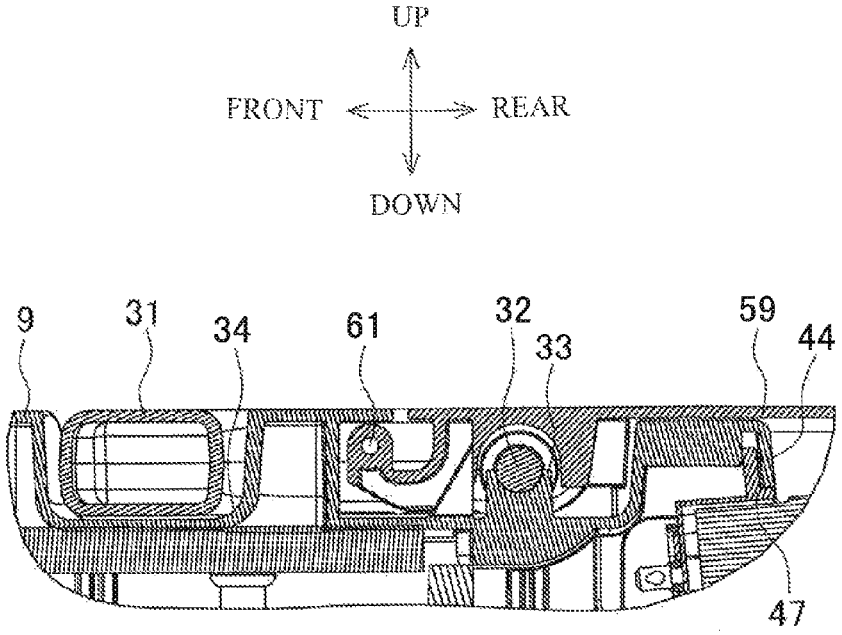
FIG. 4 is an enlarged cross-sectional view of a connecting portion between a handle and a cover.

Furthermore, a handle 31 is provided in an upper part of the main body 3. The handle 31 has a C-shape and is connected so as to rotate between a standing position in which the handle 31 protrudes upward from the upper cowling 9 and a turned-down position in which the handle 31 is turned down forward. The handle 31 is connected between the standing position and the turned-down position in such a manner that handle rotation shafts 32, 32 projecting so as to face the insides of right and left both ends are inserted into and held in receive portions 33, 33 provided in the upper cowling 9 at the center in the front and rear direction as shown in FIG. 4. In the turned-down position, the handle 31 is fitted to a recessed portion 34 that is provided on an upper surface of the upper cowling 9 so as to be recessed in the same shape of the handle 31, so that the handle 31 does not project from the upper surface of the upper cowling 9. A numeral 35 denotes a clearance recessed portion formed in the upper cowling 9 such that the clearance recessed portion 35 is continued from the recessed portion 34 in the rear center of the recessed portion 34. Pulling of the handle 31 from the turned-down position can thus be facilitated.

In the center of a rear portion of the upper cowling 9 in the right and left direction, a housing portion 36 is formed. The housing portion 36 is a recessed portion in which the center of a rear surface is positioned forward of the rearmost surface of the upper cowling 9 and the center of an upper surface is positioned in the lower side of the uppermost surface of the upper cowling 9. In the housing portion 36, two battery connection portions 37 to which battery packs 38 are detachably attached are provided in the rear surface. The battery pack 38 is used also as a power supply for an electric tool. The battery pack 38 has a well-known structure in which a coupling portion having a connection terminal between right and left rail portions is provided on an upper surface of a case which houses plural storage batteries. Accordingly, as in the same configuration as that of the electric tool to which the battery pack 38 is fitted, the battery connection portion 37 has a right and left pair of guide rails 39, 39 extending upward, to which the rail portions of the coupling portion can be fitted, and a terminal block 40 having terminal boards 41, 41 is provided so as to face upward. Therefore, the battery pack 38 can be inserted and fitted to the battery connection portion 37 from above in a portrait orientation. Accordingly, it is easy to insert the battery pack 38. A recessed portion 42, a cross section of which is a semicircular shape, is formed extending in the right and left direction on an upper surface of the housing portion 36. In the recessed portion 42, small articles such as tools can be housed.

Figure 5:
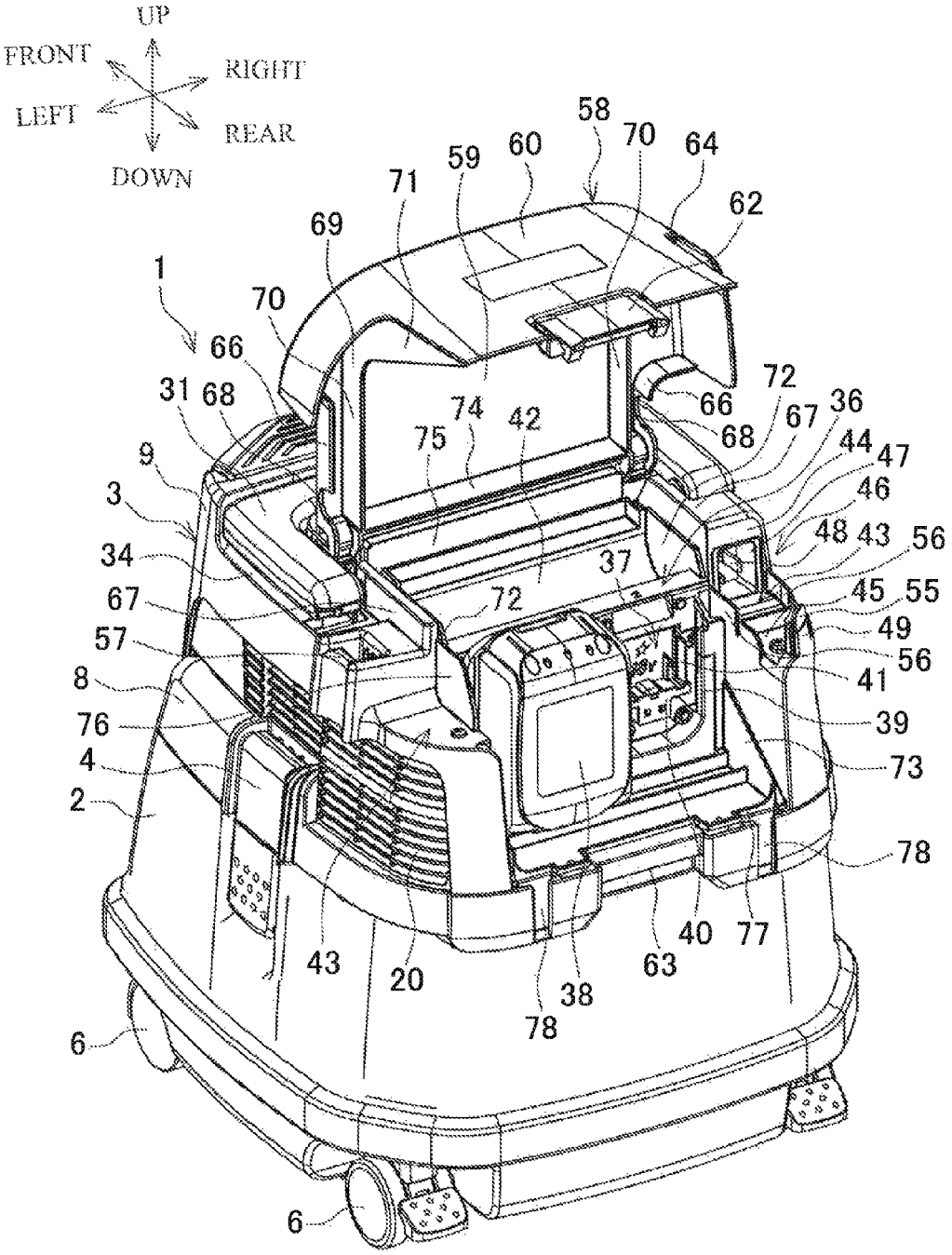
FIG. 5 is a perspective view of the dust collecting device seen from the rear side (the cover is in an opened position and a power cord is not connected).
Figure 6:
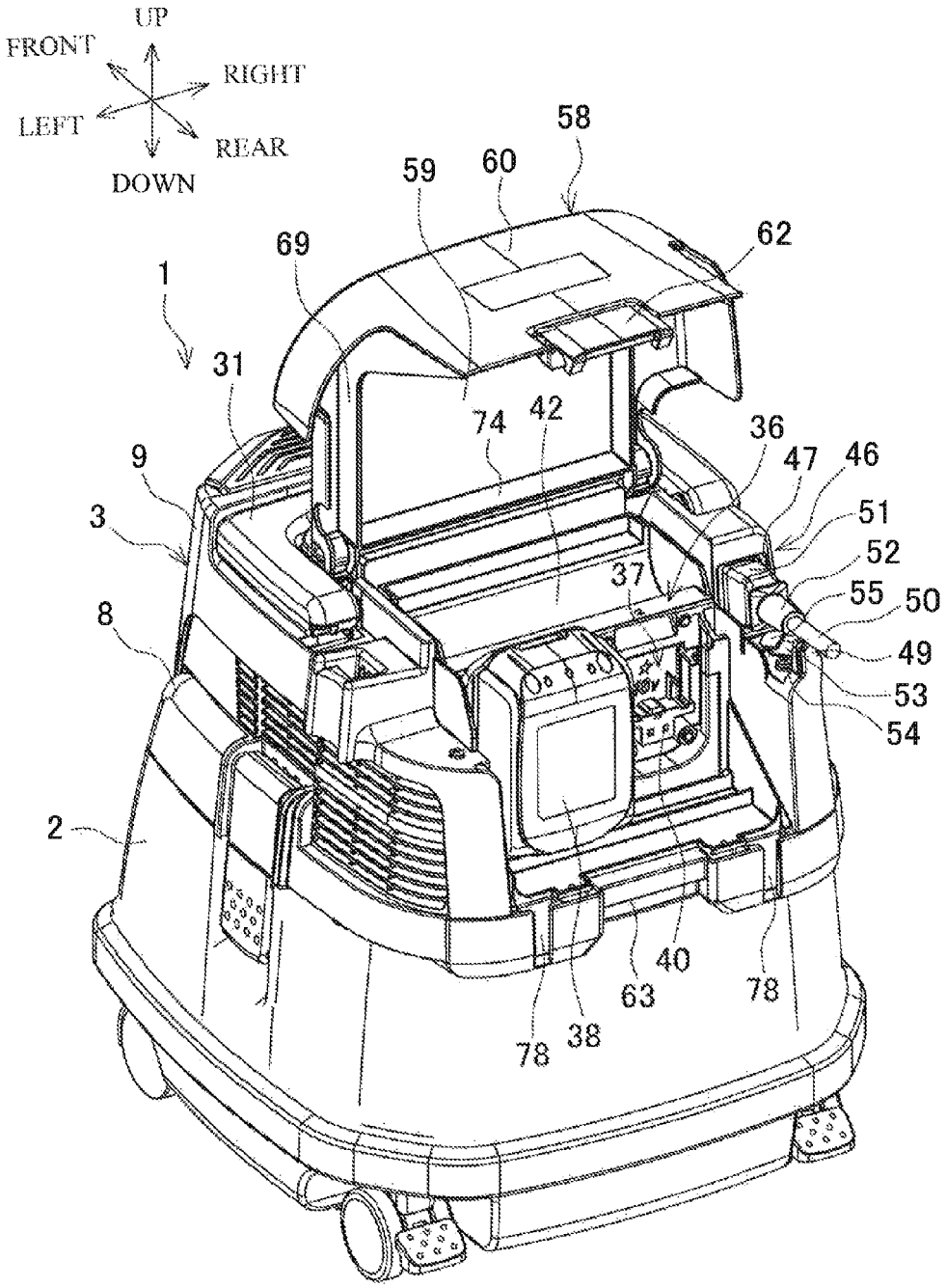
FIG. 6 is a perspective view of the dust collecting device seen from the rear side (the cover is in the opened position and the power cord is connected).
Figure 7:
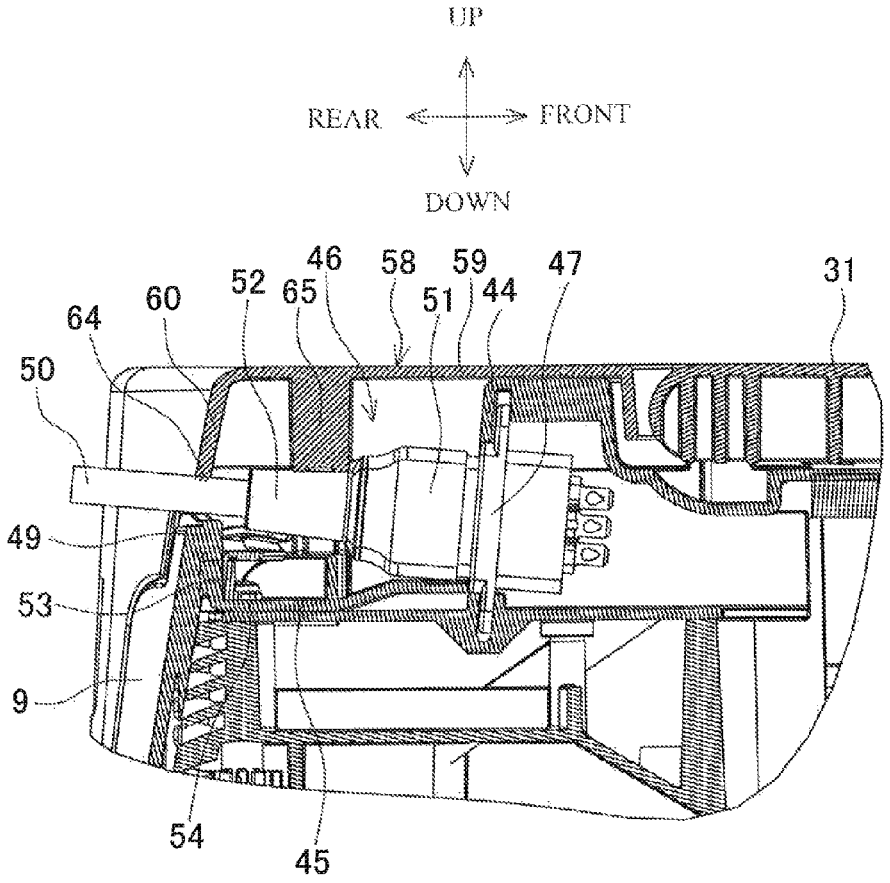
FIG. 7 is an enlarged cross-sectional view of a cord connection portion.

Furthermore, step portions 43, 43 are formed at right and left of the housing portion 36 in the upper cowling 9 so as to be positioned lower than the upmost surface of the upper cowling 9. In the right-side step portion 43, a cord connection portion 46 is provided as shown in FIG. 5. The cord connection portion 46 is formed so that a plug receptacle 47 having a metal terminal 48 thereinside is provided in a vertical plate portion 44 forming the step portion 43 and faces the rear side, and a standing piece 49 is provided so as to stand at a rear end of a lateral plate portion 45 behind the plug receptacle 47. A power cord 50 includes a connecting plug 51 that is to be inserted into the plug receptacle 47 at one end, and a not-shown attachment plug that is to be connected to a wall outlet at the other end, respectively as shown in FIGS. 6 and 7. A bending restriction portion 52 having a larger diameter than the cord is continuously provided at an end portion of the connecting plug 51, and the power cord 50 passes above the standing piece 49 in a state where the connecting plug 51 is connected.

A base end of an elastic cover 53 is fixed to the lateral plate portion 45 by a screw 54 at the inside of the standing piece 49. In a state where the power cord 50 is not inserted, a tip portion 55 of the elastic cover 53 can be placed on an upper end of the standing piece 49 in the extending direction of the standing piece 49. When the power cord 50 is inserted, the elastic cover 53 abutting on the connecting plug 51 is folded inside, and thus the tip portion 55 is retracted from the standing piece 44.

Additionally, small ribs 56, 56 are positioned at right and left of the connecting plug 51 inserted into the plug receptacle 47 so as to stand at right and left of the lateral plate portion 45.

In the upper cowling 9 between the left-side step portion 43 and the handle 31, a pipe support portion 57 is provided. The pipe support portion 57 locks a not-shown hook provided in a pipe for extension to be connected to the hose so that the pipe is supported in an up and down direction. The pipe support portion 57 is arranged so that the pipe in the supported state does not interrupt opening and closing of a cover 58 as well as does not interfere with the handle 31 even when the handle 31 is raised up.

The numeral 58 denotes the cover covering the housing portion 36 and right and left step portions 43, 43. The cover includes an upper plate portion 59 covering upper parts of the housing portion 36 and the step portions 43, 43, and a rear plate portion 60 covering a rear part of the housing portion 36 and rear parts and side parts of the step portions 43, 43. A front end portion of the upper plate portion 59 extends forward in such a manner that a width is fitted between both end portions of the handle 31. The front end portion of the upper plate portion 59 is connected to the upper cowling 9 between the handle rotation shafts 32 of the handle 31 and the clearance recessed portion 35 by a cover rotation shaft 61 in the right and left direction (FIG. 4). Accordingly, the cover 58 can rotate between an opened position and a closed position. In the opened position, the upper plate portion 59 rotates so as to face upward and opens the housing portion 36 and the step portions 43, 43. In the closed position, the upper plate portion 59 is on an extended surface of the upper surface of the upper cowling 9 and covers the housing portion 36 and the step portions 43, 43. As the cover rotation shaft 61 of the cover 58 is arranged forward of the handle rotation shafts 32 as described above, the upper plate portion 59 is formed long in the front and rear direction, therefore, the housing portion 36 can be opened wide at the opened position. Additionally, a hook 62 is provided at a lower end of the rear plate portion 60 and elastically locked to a locked portion 63 provided at the lower cowling 8 in the closed position of the cover 58.

Figure 8:
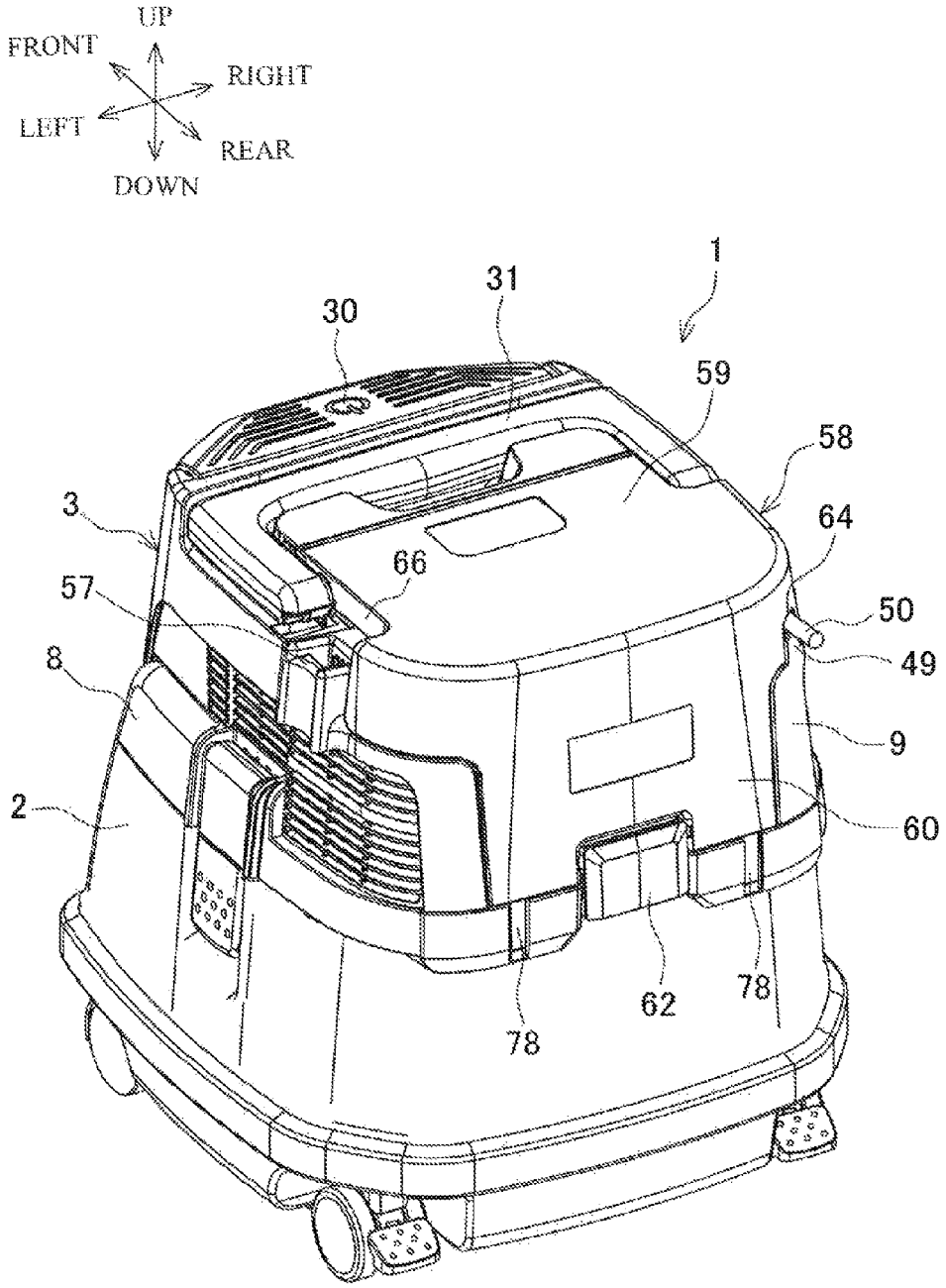
FIG. 8 is a perspective view of the dust collecting device seen from the rear side (the power cord is connected).

On the right side of the rear plate portion 60 of the cover 58, a notch 64 is provided, and the standing piece 49 of the cord connection portion 46 is fitted to the notch 64 in the closed position. The notch 64 is formed to be deeper than the height of the standing piece 49, which forms a space to which the power cord 50 shown in FIG. 8 can be inserted between the notch 64 and the standing piece 49 in a fitted state to the standing piece 49. When there is not the power cord 50, the tip portion 55 of the elastic cover 53 is fitted to close the space (FIG. 2).

Moreover, in an inner face of the upper plate portion 59 of the cover 58, a fall-off stopper protrusion 65 is provided as a fall-off stopper portion. The fall-off stopper protrusion 65 protrudes and abuts on the bending restriction portion 52 of the power cord 50 from above in a state where the connecting plug 51 of the power cord 50 is inserted into the plug receptacle 47 and the cover 58 is rotated to the closed position. Accordingly, the connecting plug 51 interferes with the fall-off stopper protrusion 65 in a fall-off direction of the power cord 50, which prevents the power cord 50 from falling off from the plug receptacle 47.

Then, bent portions 66, 66 are formed at right and left edges of the upper plate portion 59. The bent portions 66 are positioned outside raised portions 67, 67. The raised portions 67, 67 are formed to be raised on the upper cowling 9 at right and left of the housing portion 36 by forming the recessed portion 34 in the closed position of the cover 58. In each bent portion 66, a clearance portion 68 is provided for avoiding the interference with respect to the handle rotation shafts 32 of the handle 31, and a rear end of the bent portion 66 is connected to the rear plate portion 60. Furthermore, a pair of lateral ribs 69, 69 are formed inside the bent portions 66 and an inner face of the cover 58. The lateral ribs 69, 69 includes strip portions 70 formed in an inner face of the upper plate portion 59 in a standing state, and inclined plate portions 71 formed in an inner face of the rear plate portion 60 in a standing state. The lateral ribs 69 are positioned inside right and left inside surfaces of the housing portion 36 in the closed position of the cover 58. Upper abutting step portions 72 on which the strip portions 70 abut and lower abutting step portions 73 on which the inclined plate portions 71 abut in the closed position of the cover 58 are formed in inside surfaces of the lateral ribs 69. In the front side of the upper plate portion 59, a strip-shaped front rib 74 connects between front ends of the strip portions 70, 70. The front rib 74 abuts on a front abutting step portion 75 formed in a front face of the housing portion 36 in the closed position of the cover 58.

Accordingly, the sealing of the housing portion 36 is realized by the lateral ribs 69 and the front rib 74 in addition to the bent portions 66 in the closed position of the cover 58, it is possible to effectively prevent invasion of water and dust to the housing portion 36. Further, in the left-side step portion 43, a small rib 76 is provided in a standing state such that the small rib 76 is continued from the raised portion 67 and positioned outside the lateral rib 69 in the closed position of the cover 58. The small rib 76 in the left side step portion 43 prevents invasion of water and so on to the housing portion 36 along with the small ribs 56 in the right-side step portion 43. In a rear end of a bottom surface of the housing portion 36, a fold-back portion 77 continued from the right and left lower abutting step portions 73, 73 and positioned inside the rear plate portion 60 in the closed position of the cover 58 is provided so as to stand, which prevents invasion of water and so on to the housing portion 36. In the cord connection portion 46, the invasion of water and so on can be prevented by the cover 58, the right and left small ribs 56.

Figure 9:
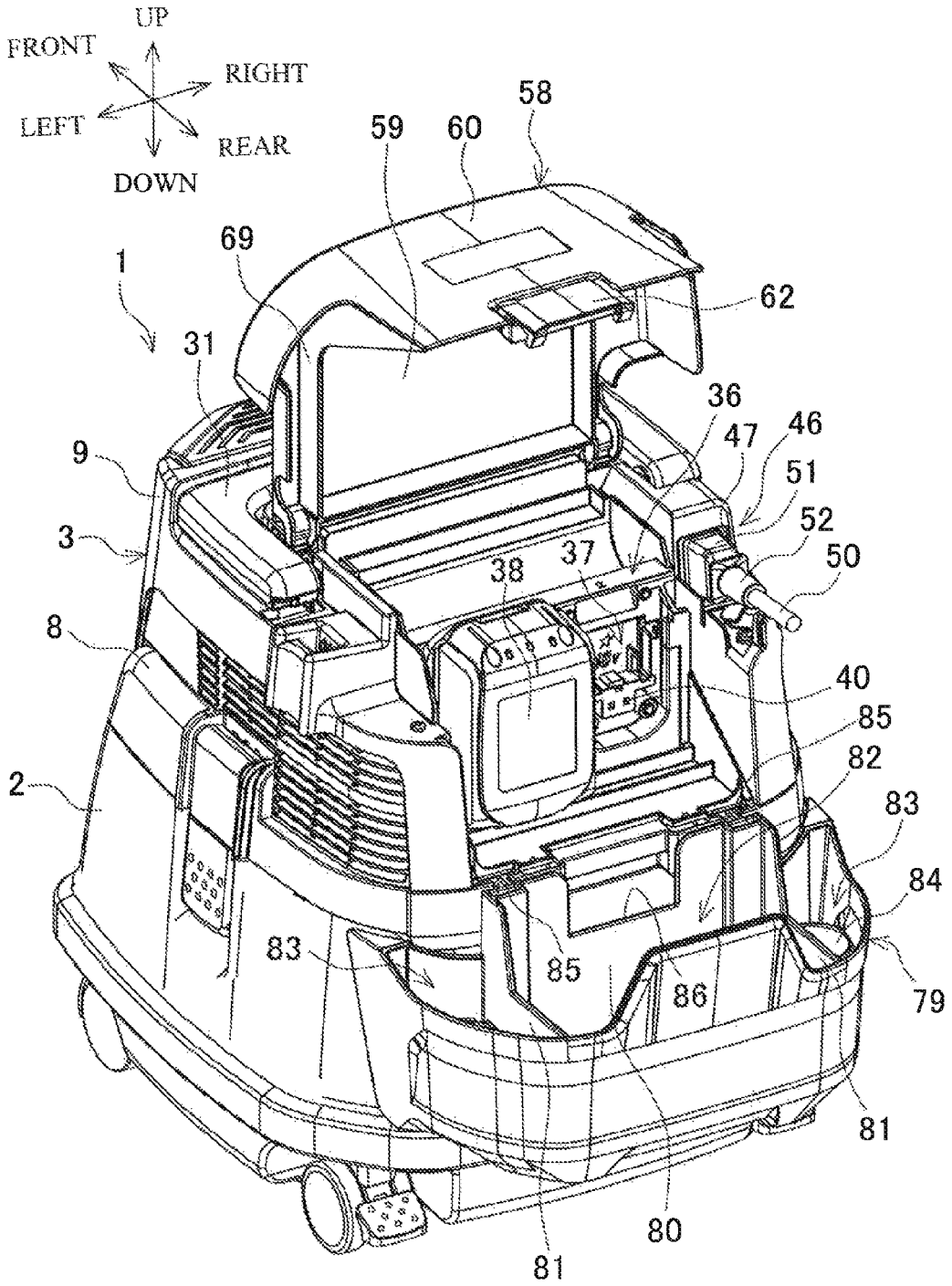
FIG. 9 is a perspective view of the dust collecting device seen from the rear side to which a housing box is connected (the cover is in the opened position and the power cord is connected).
Figure 10:
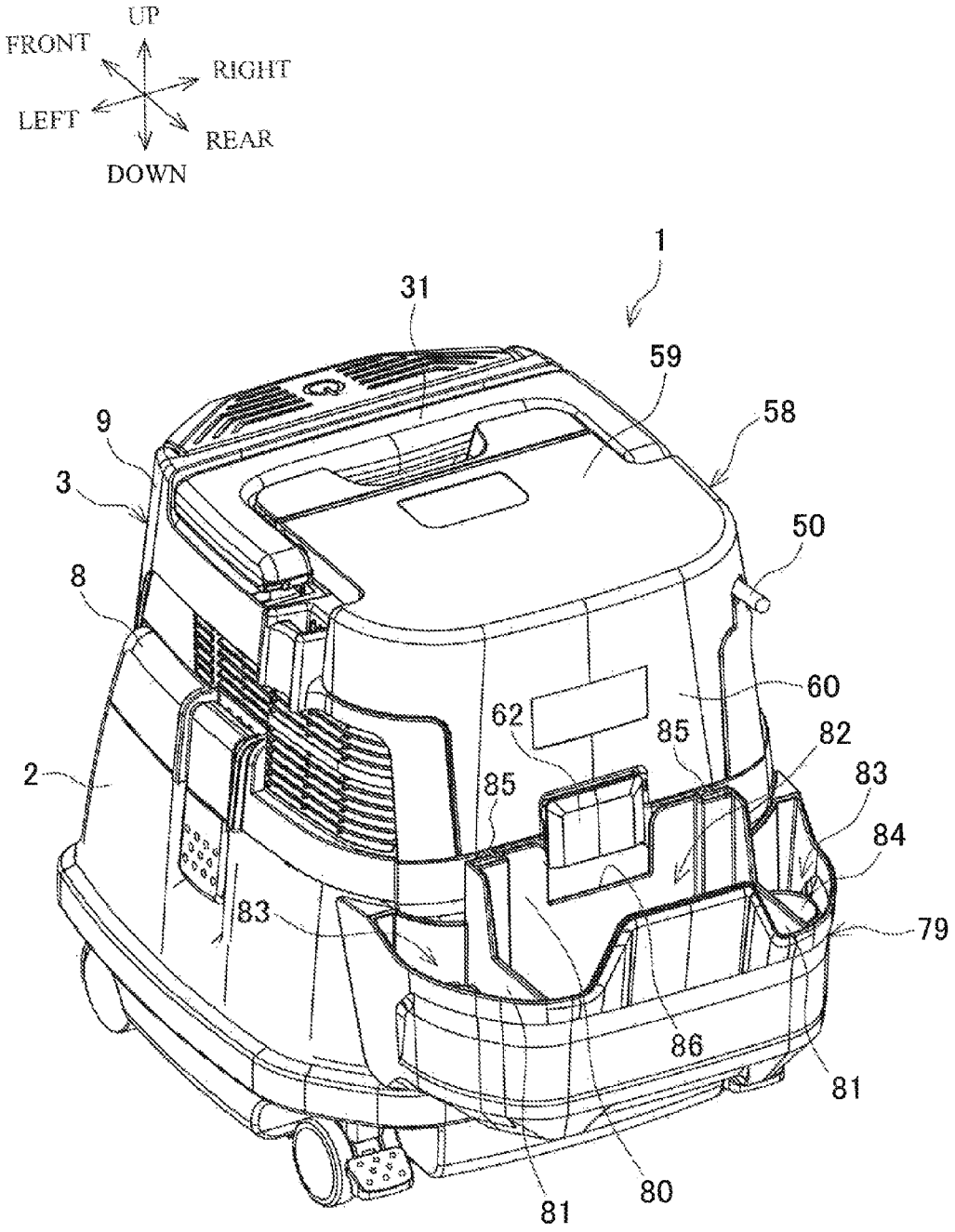
FIG. 10 is a perspective view of the dust collecting device seen from the rear side to which the housing box is connected (the cover is in a closed position and the power cord is connected).
Figure 11:
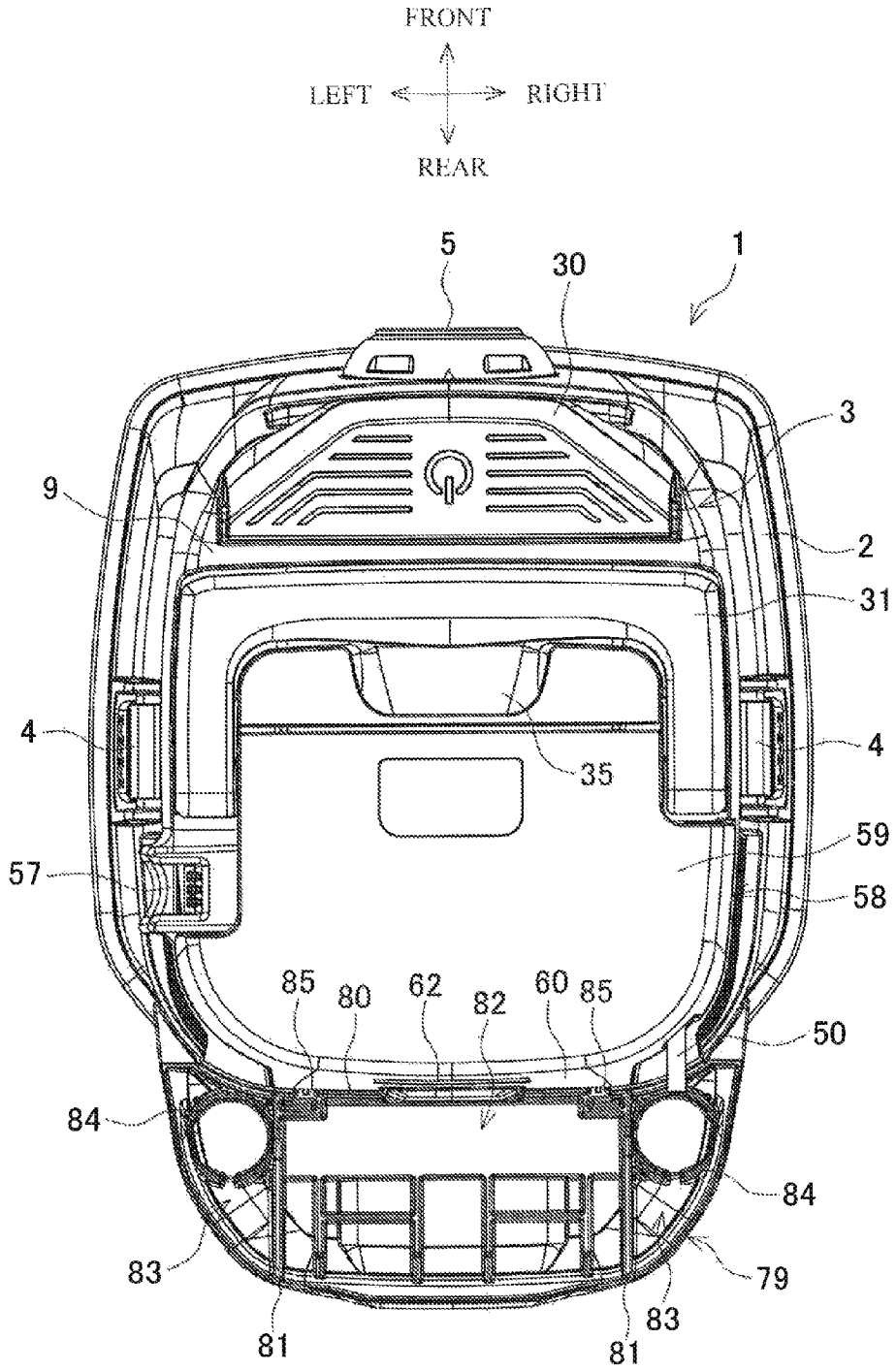
FIG. 11 is a plan view of the dust collecting device to which the housing box is connected.

A pair of coupling portions 78, 78 are provided at the lower cowling 8 in a rear part of the dust collecting device 1 so as to be positioned in right and left of the locked portion 63. A housing box 79 can be connected to the coupling portions 78, 78. As shown in FIG. 9 to FIG. 11, the housing box 79 has a pocket shape, an upper part of which is opened.

A front wall portion 80 of the housing box 79 has a curved shape corresponding to the outer periphery of the tank 2. A first housing portion 82 which can house two auxiliary battery packs and so on are formed inside the housing box 79 by right and left partition plates 81, 81. Second housing portions 83 which have cylindrical holding portions 84 so as to face upward and which can house attachments such as pipes are formed at both ends of the first housing portion 82. A pair of fitting protrusions 85, 85 has a I-shape in plan view and protrudes at right and left of an upper end of the front face of the front wall portion 80.

The coupling portions 78 are T-shape grooves which can receive the fitting protrusions 85 from above. The coupling portions 78, 78 are exposed in the opened position of the cover 58, and a lower end of the rear plate portion 60 of the cover 58 is positioned above the coupling portions 78, 78 in the closed position.

Figure 12:
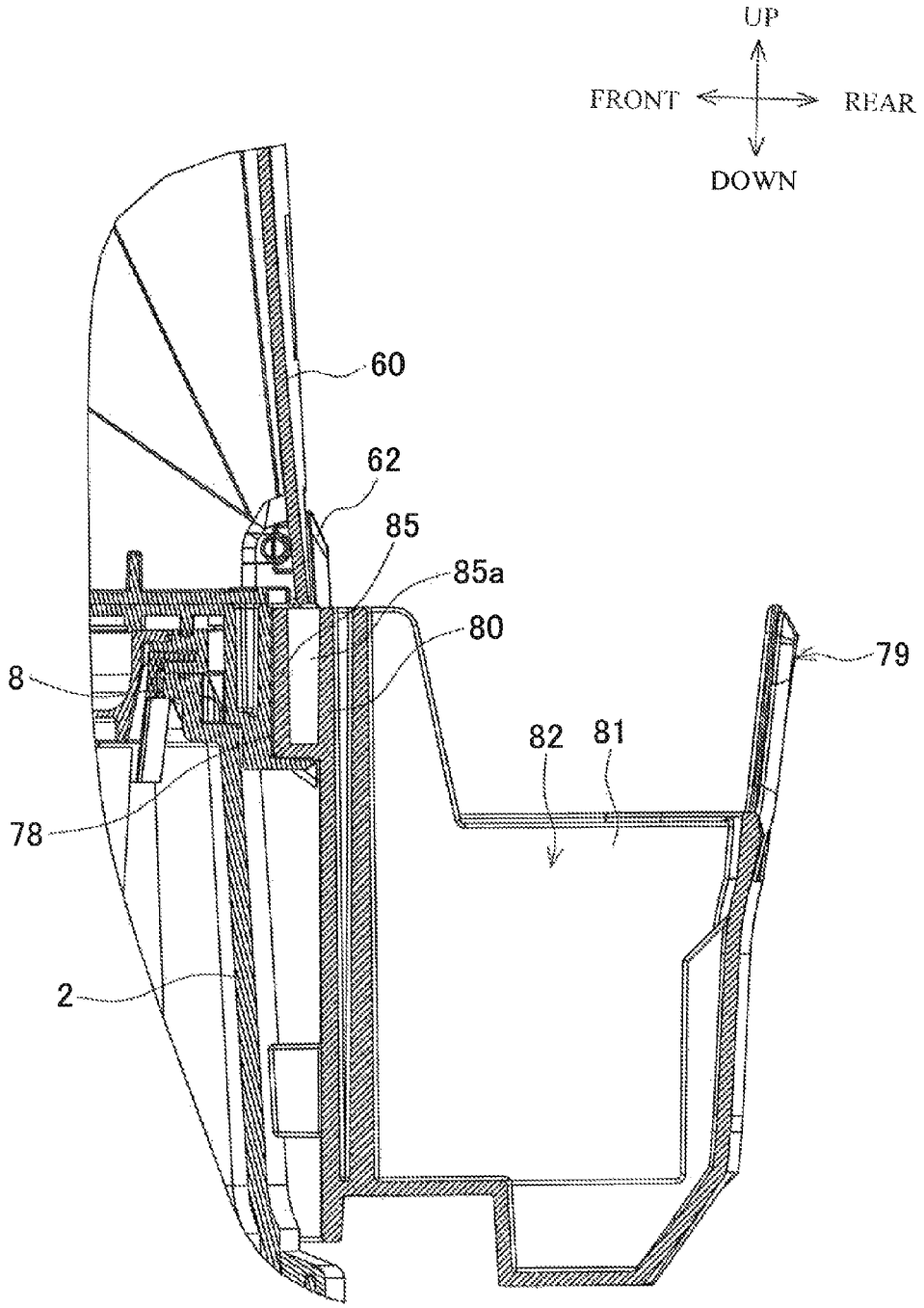
FIG. 12 is an enlarged cross-sectional view of a connecting portion of the housing box.

Accordingly, when respective fitting protrusions 85 of the housing box 79 are fitted to the coupling portions 78 from above in a state where the cover 58 is rotated in the opened position, the housing box 79 is connected in a state of being hung from the lower cowling 8 as well as in a state in which fall-off in a rear direction is stopped. The fitting protrusions 85 do not protrude upward from the coupling portions 78 in the above state. Here, when the cover 58 is rotated to the closed position, the lower end of the rear plate portion 60 is positioned above the fitting protrusions 85 as shown in FIG. 12, therefore, fall-off of the housing box 79 to the upward direction is stopped by the cover 58. It is difficult to remove the housing box 79 unless the cover 58 is rotated to the opened position. In the upper end center of the front wall portion 80 of the housing box 79, a notch 86 is formed. With the notch 86, the hook 62 of the cover 58 can be locked and unlocked with respect to the locked portion 63 even in the state where the housing box 79 is connected. A sign 85*a* denotes a recessed portion formed in the fitting protrusion 85, and a load due to the weight from the housing box 79 can be received by the fitting protrusions 85 which is elastically deformed by the recessed portions 85*a*.

In the dust collecting device 1 having the above structure, the cover 58 is rotated to the opened position and one or two battery packs 38 are mounted from above on the battery connection portions 37 of the housing portion 36 exposed by rotating the cover 58 to the opened position when the battery pack 38 is used as a power source. When the cover 58 is rotated to the closed position, the housing portion 36 and the right and left step portions 43, 43 are covered.

When any of the operation switches 27, 30 is turned on in this state, the motor 11 is driven and the blower fan 16 is rotated. Accordingly, outside air is sucked into the tank 2 through a hose connected to the suction opening 5, reaches the discharge passage 19 from the blower fan 16 through the filter 24, and is discharged to the outside from the exhaust port 20. Therefore, the dust caught by the filter 24 is stored in the tank 2.

When the battery pack 38 is removed to charge the battery, the exposed battery pack 38 can be pulled out to the upper direction after rotating the cover 58 to the opened position in the same manner as mounting. In the rear plate portion 60 of the cover 58, a left-side end portion where the pipe support portion 57 is provided is shorter than a right-side end portion. Therefore, the cover 58 can be opened and closed without interference with respect to the pipe even when the pipe is supported by the pipe support portion 57.

In the case where a commercial power supply is used as a power source, the connecting plug 51 of the power cord 50 is inserted into the plug receptacle 47 of the cord connection portion 46 exposed by the rotation of the cover 58 to the opened position, and the cover 58 is rotated to the closed position, then housing portion 36 and the right and left step portions 43, 43 are covered. At this time, the power cord 50 is pulled out to the outside from the notch 64 in the state where the fall-off stopper protrusion 65 of the upper plate portion 59 abuts on the bending restriction portion 52 of the power cord 50 to stop fall-off of the power cord 50 as described above.

When any of the operation switches 27, 30 is turned on in the above state, the motor 11 is driven and the blower fan 16 is rotated, then, outside air is sucked and the dust caught by the filter 24 is stored in the tank 2 as described above.

In the case where the power cord 50 is removed, the cover 58 is rotated to the opened position in the same manner as connection, and then the fall-off stopper protrusion 65 is separated from the power cord 50. Therefore, the connecting plug 51 can be pulled out from the plug receptacle 47 smoothly.

In the dust collecting device 1 having the above structure, as the fall-off stopper protrusion 65 for stopping fall-off of the power cord 50 connected to the cord connection portion 46 is provided as described above, it is possible to stop the fall-off of the power cord 50 with a simple structure and realize the structure of having the power cord 50.

Particularly in this case, the fall-off stopper protrusion 65 is provided in the cover 58 which covers the cord connection portion 46. Therefore, a rational structure is obtained in which the fall-off of the power cord 50 is stopped at the same time as closing of the cover 58, and the stop of fall-off is released at the same time as opening, which improves usability. It is also possible to protect (waterproofing, dust-proofing) of the cord connection portion 46 by the cover 58.

However, the form of the fall-off stopper portion is not limited to the fall-off stopper protrusion 65 and can be suitably modified. For example, a plate-shaped body with a notch to which the cord is fitted and a structure in which the fall-off stopper protrusion is provided in the upper cowling and the power cord is sandwiched by upper and lower protrusions may also be applied. The position or the orientation of the cord connection portion is not limited to the above form either. It is possible to apply a structure in which the cord connection portion and the pipe support portion are provided with the right and left sides reversed, a structure in which the cord connection portion is provided so as to face a lateral direction, and a structure in which the cord connection portion is provided in the housing portion if there is enough room.

The present invention can be also applied not only to the fall-off stopper for the power cord of the dust collecting device but also a fall-off stopper for a power cord to be connected to an interlocking outlet of an electric tool. Therefore, the present invention can be also applied to an AC dust collecting device only using a commercial power supply as a power source.

Further, in the dust collecting device 1 having the above structure, the cover rotation shaft 61 is provided in parallel to the handle rotation shafts 32. The cover rotation shaft 61 is positioned closer to a grip portion G of the handle 31 than the handle rotation shafts 32 so that the cover rotation shaft 61 overlaps with a part of the handle 31. The handle rotation shafts 32 are positioned closer to the cover 58 than the cover rotation shaft 61 so that the handle rotation shafts 32 overlap with a part of the cover 58. Therefore, the cover 58 can be formed long in the front and rear direction and the large opening in the cover 58 can be secured without increasing the product size. Accordingly, attachment and detachment of the battery pack 38 with respect to the housing portion 36 can be easily performed.

In the above embodiment, the upper plate portion of the cover between both end portions of the handle extends forward of the handle rotation shafts in order to arrange the cover rotation shaft forward of the handle rotation shafts. However, it is also possible, conversely to the above, to arrange the cover rotation shaft forward of the handle rotation shafts by reducing the size of the handle in the right and left direction and extending right and left ends of the upper plate portion of the cover to the outsides of the both end portions of the handle. It is also possible to arrange the both end portions of the handle and the right and left ends of the upper plate portion of the cover alternatively one by one. Accordingly, the handle overlaps with the cover rotation shaft and the cover overlaps with the handle rotation shafts.

Furthermore, the housing portion covered by the cover may house only accessories and tools.

In the duct collecting device 1 according to the embodiment, the detachable housing box 79 can be provided in the duct collecting device 1. In particular, as the cover 58 restricts the movement in a direction of removing the housing box 79 in the closed position of the housing portion 36, the detachable housing box 79 can be positively fixed at the time of connection and can be easily removed by opening the cover 58.

The present invention can be also applied to a structure in which a cover is opened and closed in the right and left direction, not limited to opening and closing in the up and down direction and a structure in which the cover opens and closes the housing portion by sliding the housing portion in the up and down direction as well as in the right and left direction, not limited to the rotation by the cover rotation shaft.

The connection of the housing box is not limited to the above embodiment and can be suitably modified, for example, the number of coupling portions and the fitting protrusions may be increased and the fitting shape may be changed (for example, a dovetail-groove fitting may be used instead of the T-shape fitting).

Furthermore, the structure of the housing box itself is not limited to the above embodiment, and the number of partition plates may be increased, the partition plates and the holding portion may be omitted or an opening and closing lid may be provided in the housing portion.

Figure 13:
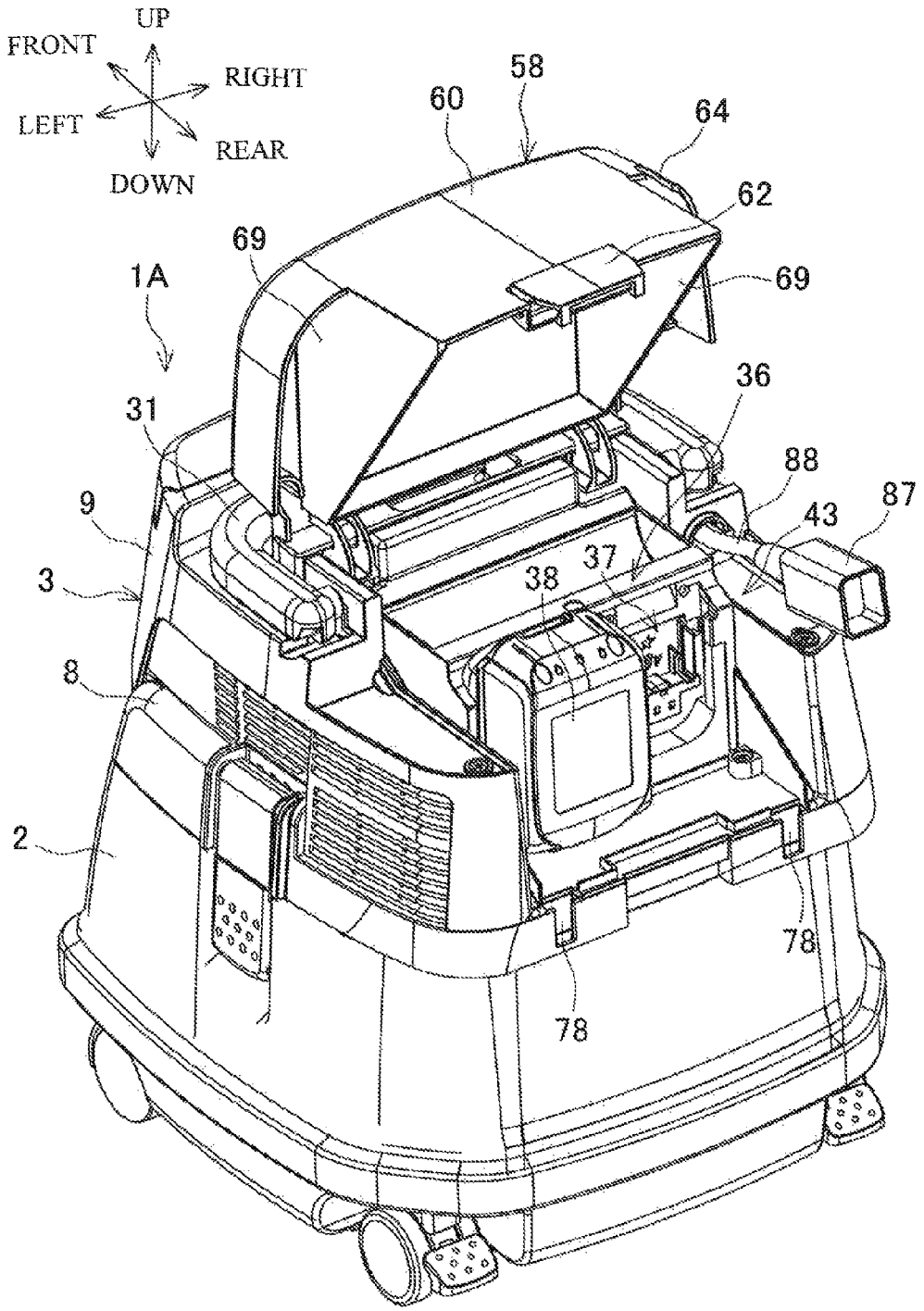
FIG. 13 is a perspective view of a dust collecting device having a plug receptacle seen from the rear side in a modification example (the cover is in the opened position and the power cord is not connected).
Figure 14:
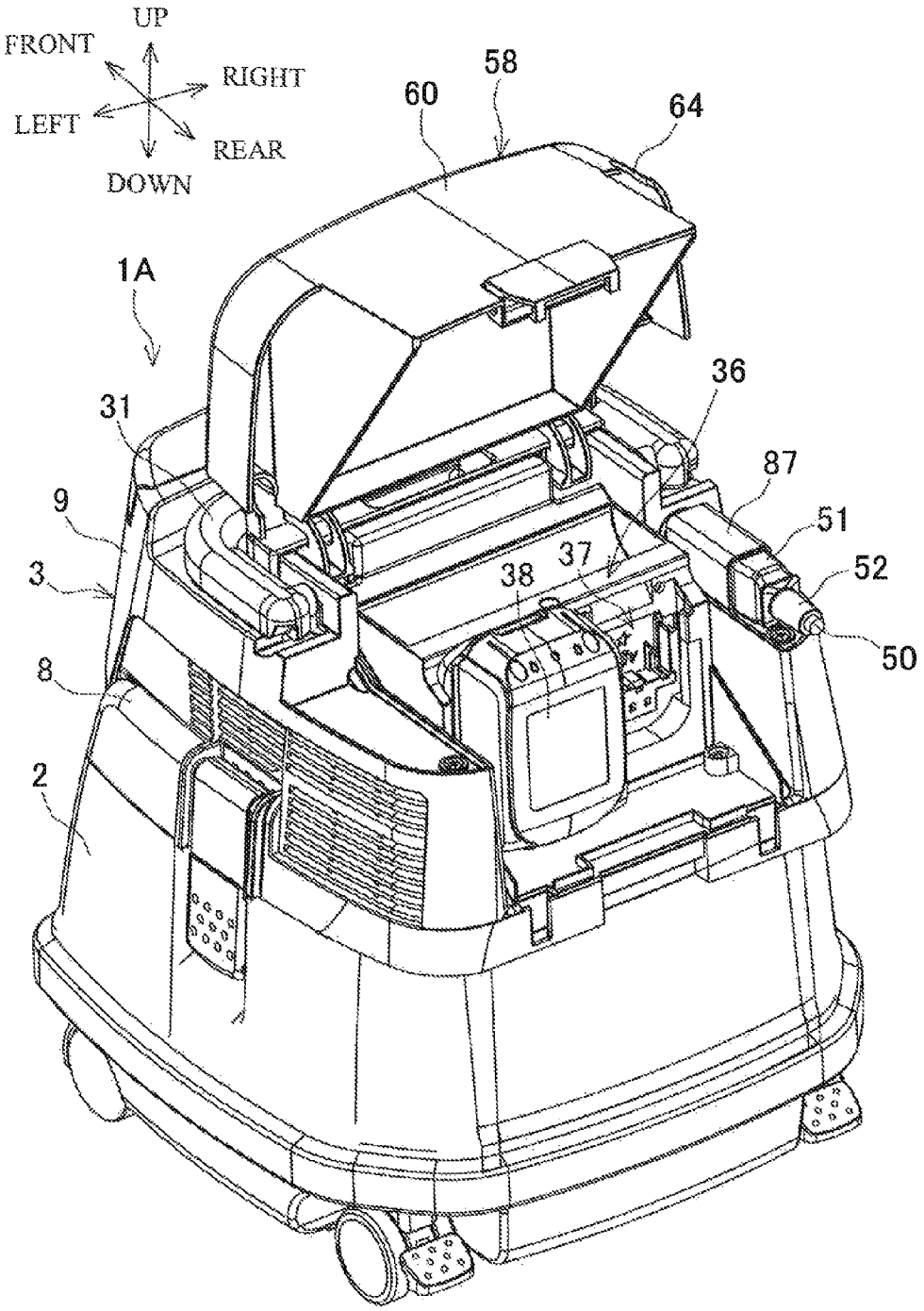
FIG. 14 is a perspective view of the dust collecting device having the plug receptacle seen from the rear side in the modification example (the cover is in the opened position and the power cord is connected).
Figure 15:
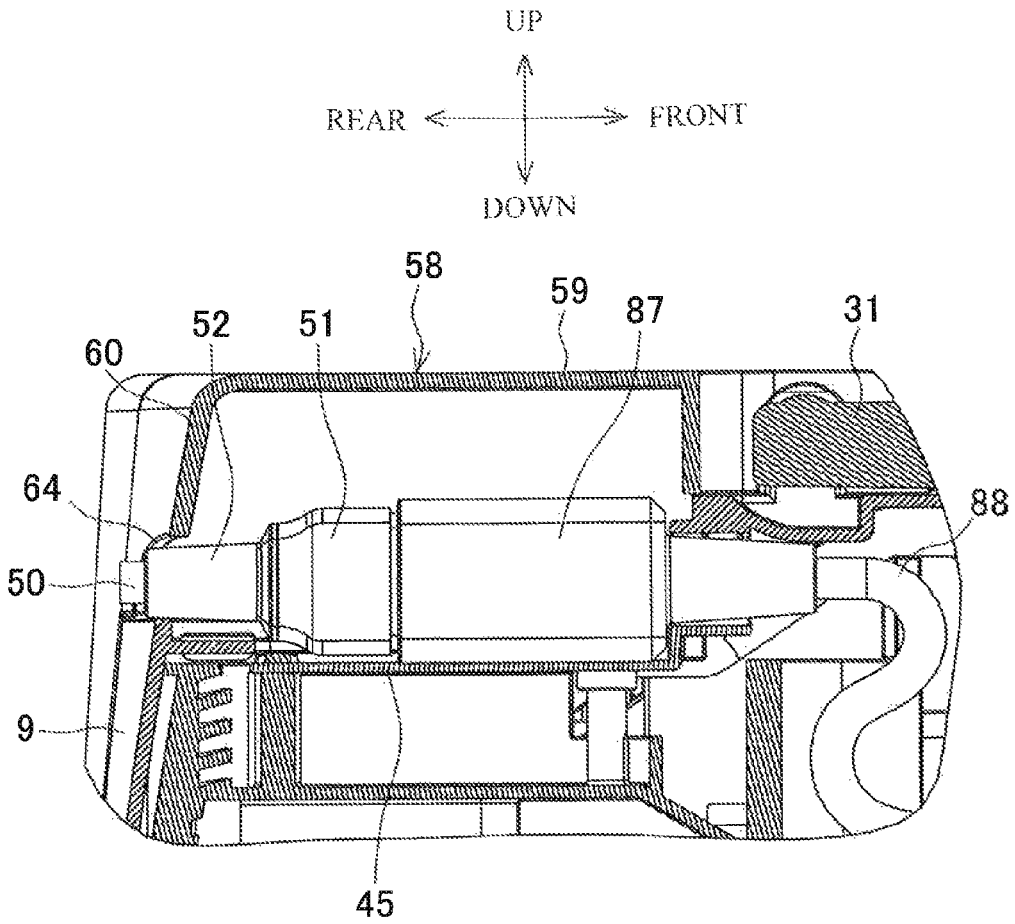
FIG. 15 is an enlarged cross-sectional view of the cord connection portion of the dust collecting device having the plug receptacle in a modification example.

On the other hand, also in a dust collecting device IA in which a plug receptacle 87 to which the power code 50 is connected is not built in the upper cowling 9 and becomes free in some degree by pulling out a cord 88 to facilitate the connection of the power cord 50 as shown in FIG. 13, the rear plate portion 60 of the cover 58 interferes with the connecting plug 51 and stops fall-off of the power cord 50 in the fall-off direction of the power cord 50 as shown in FIG. 15 by closing the cover 58 in a state where the plug receptacle 87 to which the connecting plug 51 is connected is set on the step portion 43 as shown in FIG. 14. At this time, the cord 88 is housed inside the main body 3 by being bent.

Accordingly, the fall-off stopper protrusion is not necessary as the rear plate portion 60 functions as the fall-off stopper portion in above case, however, the fall-off stopper protrusion can be further provided depending on forms of the connecting plug 51 and the plug receptacle 87.

It is explicitly stated that all features disclosed in the description and/or the claims are intended to be disclosed separately and independently from each other for the purpose of original disclosure as well as for the purpose of restricting the claimed invention independent of the composition of the features in the embodiments and/or the claims. It is explicitly stated that all value ranges or indications of groups of entities disclose every possible intermediate value or intermediate entity for the purpose of original disclosure as well as for the purpose of restricting the claimed invention, in particular as limits of value ranges.

What is claimed is:

1. A dust collecting device comprising:

a tank; and a main body housing a motor and detachably attached to an upper part of the tank, wherein a handle which is capable of being raised and turned down around a handle rotation shaft and a cover which is capable of being opened and closed around a cover rotation shaft and which covers a housing portion provided in the main body in a closed position are provided in an upper part of the main body, the cover rotation shaft is provided in parallel to the handle rotation shaft, the cover rotation shaft being positioned closer to a grip portion of the handle than the handle rotation shaft so as to overlap with a part of the handle, and the handle rotation shaft being positioned closer to an end of the cover than the cover rotation shaft so as to overlap with a part of the cover, and the cover includes an upper plate portion that overlaps the handle rotation shaft in a closed position of the cover such that the cover is above and covers the handle rotation shaft.

2. The dust collecting device according to claim 1, wherein the housing portion is provided with a battery connection portion for connecting a battery.

3. The dust collecting device according to claim 1, wherein a switch for activating the motor is arranged in a front part of the main body, the handle is arranged in a rear side of the switch and the cover is arranged in a rear side of the handle respectively.

4. The dust collecting device according to claim 1, wherein a clearance recessed portion facing the handle in a turned-down state is formed on an upper surface of the main body.

5. The dust collecting device according to claim 1, wherein a pipe support portion configured to support a pipe is provided in the main body, and the cover has a shape not interfering with the pipe supported by the pipe support portion at the time of opening and closing.

6. The dust collecting device according to claim 1, wherein the cover is provided with a hook elastically locked to the main body in a closed position of the housing portion.

7. The dust collecting device according to claim 1, wherein a detachably attached housing box is provided in the main body.

8. The dust collecting device according to claim 7, wherein, in a closed position of the housing portion, the cover restricts movement of the housing box in a direction of removing the housing box.

9. The dust collecting device according to claim 8, wherein the housing box is attached to the main body by inserting fitting protrusions protruding on an outer surface into coupling portions provided in the main body from above, and the cover is provided so as to rotate in an up and down direction to close the housing portion provided above the coupling portions from above.

10. The dust collecting device according to claim 7, wherein the housing box has a pocket shape an upper part of which is opened, and partition plates are provided thereinside.

11. The dust collecting device according to claim 7, wherein a suction opening is arranged in a front part of the main body, and the housing box is arranged in a rear part of the main body.

12. The dust collecting device according to claim 7, wherein the housing portion is provided with a battery connection portion for connecting a battery, and the battery is capable of being housed in the housing box.

13. A dust collecting device comprising:

a tank; and a main body housing a motor and detachably attached to an upper part of the tank, wherein a handle which is capable of being raised and turned down around a handle rotation shaft and a cover which is capable of being opened and closed around a cover rotation shaft and which covers a housing portion provided in the main body in a closed position are provided in an upper part of the main body, the cover rotation shaft is provided in parallel to the handle rotation shaft, the cover rotation shaft being positioned closer to a grip portion of the handle than the handle rotation shaft so as to overlap with a part of the handle, and the handle rotation shaft being positioned closer to an end of the cover than the cover rotation shaft as to overlap with a part of the cover, a cord is connectable to the main body, the main body is provided with a fall-off stopper portion stopping fall-off of the connected cord from the main body, and the cover covers a cord connection portion to which the cord is connected, and has the fall-off stopper portion.

14. The dust collecting device according to claim 13, wherein a battery connection portion to which a battery is connectable is provided in the main body, and the cover covers both the cord connection portion and the battery connection portion.

15. The dust collecting device according to claim 13, wherein ribs positioned inside the cover are provided at right and left of the cord in the cord connection portion.

16. A dust collecting device comprising:

a tank; and a main body housing a motor and detachably attached to an upper part of the tank, wherein a handle which is capable of being raised and turned down around a handle rotation shaft and a cover which is capable of being opened and closed around a cover rotation shaft and which covers a housing portion provided in the main body in a closed position are provided in an upper part of the main body, the cover rotation shaft is provided in parallel to the handle rotation shaft, the cover rotation shaft being positioned closer to a grip portion of the handle than the handle rotation shaft so as to overlap with a part of the handle, and the handle rotation shaft being positioned closer to an end of the cover than the cover rotation shaft so as to overlap with a part of the cover, a battery connection portion is arranged in a rear part of the main body, the battery connection portion having (i) a pair of right and left guide rails extending in an upward direction and being configured to receive rail portions of a battery pack, and (ii) a terminal block facing in the upward direction and having terminal boards, and the battery connection portion is configured to receive the battery pack in a portrait orientation from a direction above the pair of right and left guide rails in the upward direction.

* * * * *